US008172703B2

(12) United States Patent
Lay

(10) Patent No.: US 8,172,703 B2
(45) Date of Patent: May 8, 2012

(54) WIND RESISTANT PRACTICE CAGE

(76) Inventor: William Coleman Lay, St. George, UT (US)

( * ) Notice: Subject to any disclaimer, the term of this patent is extended or adjusted under 35 U.S.C. 154(b) by 394 days.

(21) Appl. No.: 11/653,101

(22) Filed: Jan. 12, 2007

(65) Prior Publication Data

US 2008/0171618 A1 Jul. 17, 2008

(51) Int. Cl.
*A63B 69/00* (2006.01)

(52) U.S. Cl. ..... 473/421; 473/422; 473/490; 473/451; 135/87; 135/90; 135/97; 135/121; 135/124; 135/125; 135/136; 135/156; 135/119; 124/1; 124/6; 124/10; 124/78; 124/81

(58) Field of Classification Search ..... 473/421, 473/422, 490, 451; 135/87, 90, 97, 121, 135/125, 143, 146, 119, 136, 156; 273/317, 273/137.6, 348, 108, 108.3; 124/1, 6, 10, 124/78, 81

See application file for complete search history.

(56) References Cited

U.S. PATENT DOCUMENTS 1,198,300 A * 9/1916 Watkins ..... 124/6
2,126,102 A * 8/1938 Fowler ..... 473/456
2,292,109 A * 8/1942 Engel ..... 473/421
2,856,941 A * 10/1958 O'Neal ..... 135/137
2,939,467 A * 6/1960 Hans Meyer et al. ..... 52/2.13
3,013,801 A * 12/1961 Kirkconnell, Jr. ..... 473/197
3,052,249 A * 9/1962 Seaman et al. ..... 135/125
3,222,067 A * 12/1965 Litwhiler et al. ..... 473/421
3,223,098 A * 12/1965 Dole, Jr. ..... 135/126
3,478,472 A * 11/1969 Kwake ..... 52/1
3,593,997 A * 7/1971 Boehner ..... 473/421
3,980,304 A * 9/1976 O'Neill et al. ..... 473/421
4,733,865 A * 3/1988 Reed ..... 473/421
4,815,736 A * 3/1989 Wright ..... 473/421
4,883,272 A * 11/1989 Lay ..... 473/436
4,890,834 A * 1/1990 Ponza ..... 473/421
4,948,141 A * 8/1990 Newman ..... 473/167
4,969,651 A * 11/1990 Comartin ..... 273/410
5,088,740 A * 2/1992 Peterson ..... 273/410
5,269,527 A * 12/1993 Noval ..... 473/197
5,359,986 A * 11/1994 Magrath et al. ..... 124/78
5,370,385 A * 12/1994 Joy ..... 473/421
5,409,230 A * 4/1995 Dunaway et al. ..... 473/161
5,452,896 A * 9/1995 Core ..... 473/164
5,524,882 A * 6/1996 Wagner ..... 473/477
5,562,288 A * 10/1996 Erkebaev ..... 273/396
5,577,721 A * 11/1996 Hardee et al. ..... 473/421
5,590,674 A * 1/1997 Eppenbach ..... 135/114
5,634,638 A * 6/1997 Havens et al. ..... 473/421
5,655,766 A * 8/1997 Klebe, Jr. ..... 473/421
5,730,442 A * 3/1998 Anderson ..... 273/400
5,730,666 A * 3/1998 Hudson ..... 473/421
5,820,494 A * 10/1998 Gates et al. ..... 473/421
5,823,885 A * 10/1998 Stempfer ..... 473/197
5,906,553 A * 5/1999 Carroccio ..... 473/421
6,155,936 A * 12/2000 Dorr ..... 473/456
6,168,540 B1 * 1/2001 McKenna ..... 473/426
6,220,776 B1 * 4/2001 Reeves ..... 403/102
6,440,013 B1 * 8/2002 Brown ..... 473/422
6,443,140 B1 * 9/2002 Crews et al. ..... 124/78

(Continued)

*Primary Examiner* — Alvin Hunter
*Assistant Examiner* — Alexander Niconovich
(74) *Attorney, Agent, or Firm* — Madson IP, P.C.

(57) ABSTRACT

A batting or ball practice cage has one or more frame members with a net attached over the frame. Frame members may be assembled having springs or elbows at the corner. A pitching machine may be aligned with the cage at one end.

20 Claims, 17 Drawing Sheets

U.S. PATENT DOCUMENTS 6,508,243 B1 * 1/2003 Long ..... 124/1
6,511,390 B2 * 1/2003 Kim ..... 473/446
6,546,924 B2 * 4/2003 Battersby et al. ..... 124/78
6,550,491 B1 * 4/2003 Bixler et al. ..... 135/145
6,615,552 B2 * 9/2003 Gillis ..... 52/83
6,926,060 B2 * 8/2005 Mark ..... 160/135
6,939,255 B2 * 9/2005 Peterson ..... 473/415
7,001,288 B2 * 2/2006 Harrell ..... 473/446
7,413,521 B2 * 8/2008 Cherry ..... 473/451
7,686,712 B2 * 3/2010 Sifrit ..... 473/478
2002/0098920 A1 * 7/2002 Bruyer et al. ..... 473/421
2003/0195061 A1 * 10/2003 Brown ..... 473/415
2005/0020389 A1 * 1/2005 Peterson ..... 473/421
2005/0176518 A1 * 8/2005 Doherty et al. ..... 473/197
2006/0293124 A1 * 12/2006 Mooney ..... 473/421
2007/0023074 A1 * 2/2007 Choi ..... 135/120.3
2007/0123369 A1 * 5/2007 Cherry ..... 473/451
2008/0171618 A1 * 7/2008 Lay ..... 473/421
2009/0286631 A1 * 11/2009 Hammons et al. ..... 473/455
2011/0030750 A1 * 2/2011 Lin et al. ..... 135/97

* cited by examiner

WIND RESISTANT PRACTICE CAGE

BACKGROUND OF THE INVENTION

1. The Field of the Invention

The present invention relates to products used in connection with practicing sports and more particularly to an enclosure within which a user may practice with a ball or similar object.

2. The Relevant Technology

Typical projectile barriers are made of netting or wire fencing mounted or secured to a pole frame. The netting or fencing surrounds user or player so a moving object (e.g., baseball, softball, soccer ball, golf ball, puck) will be constrained in a predetermined area.

Many practice cages are erected outdoors. Thus the cage is exposed to the elements including wind. Even though the projectile barriers (e.g., netting or fencing) have holes, they can be a barrier to wind. Thus the frame must be sufficiently rigid to support the netting or fencing, but also must be made of suitable materials to withstand high winds (e.g., greater than 40 miles per hour). Thus the pole frame structure used to build practice cages typically use rigidly heavy pole frames mainly manufactured out of steel, aluminum, or thick walled plastic tubing. Also, because the pole frames are rigid, the manufacturer must spend a great deal of time and money bending and forming the pole frames into shape.

In some applications, fiberglass tubing has been preferred because plastic tubing becomes brittle in the cold and will crack or break when hit by a moving projectile. However, fiberglass typically cannot be made to have desired strength characteristics. In short, for appropriate sizes, it flexes too much. Also fiberglass poles may split or break. Also, because fiberglass rod is flexible, other rigid materials are used to form corners or angled junctions. Thus fiberglass is typically used to form a frame that is an arch.

The arched fiberglass shape is stronger. However an arch is largest at the bottom of the frame and bends in toward the batter. Thus, the swinging area is reduced for a given foot print. Thus the foot print is enlarged and more material used to make the swinging area equal to a squared frame. Also, since the fiberglass has limited rigidity, the wind has a tendency to blow the arched pole frame side-to-side which overflexes the poles and causes the poles to stress fracture, crack, and/or break.

In U.S. Pat. No. 4,815,736 (Robert Wright), the frame members are formed by a plurality of releasably coupled plastic pipes which are inherently rigid. In U.S. Pat. No. 5,634,638 (Havens, et al.) rounded elbow joints are used to assemble a rigid pole frame. Rigid frames using all rigid frame members are disclosed in U.S. Pat. No. 5,577,721 (Hardee, et al.), U.S. Pat. No. 5,370,385 (Joy), and U.S. Pat. No. 5,820,494 (Gates, et al.).

Flexible frames are also known. See U.S. Pat. No. 5,269,527 (Noval) and U.S. Pat. No. 5,088,740 (Peterson).

BRIEF SUMMARY OF THE INVENTION

A practice cage for use with a movable object has at least one frame member and in some applications multiple frame members. The frame members have abase means for associating the frame member with a support surface. A left upright member and a right upright member are associated with the base to extend upwardly therefrom. A cross member extend is connected to and extends between the upper ends of the right member and the left member. Netting means is mounted to said frame member. The netting means is configured to restrain the movement of a moveable object.

In other alternate but preferred arrangements, the frame may be configured to tip or to have a pitching hole formed to register with a pitching machine.

BRIEF DESCRIPTION OF THE DRAWINGS

To further clarify the above and other advantages and features of the present invention, a more particular description of the invention will be rendered by reference to specific embodiments thereof which are illustrated in the appended drawings. It is appreciated that these drawings depict only typical embodiments of the invention and are therefore not to be considered limiting of its scope. The invention will be described and explained with additional specificity and detail through the use of the accompanying drawings in which.

DETAILED DESCRIPTION OF THE PREFERRED EMBODIMENTS

Figure 1:
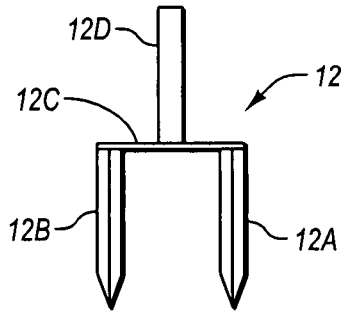
FIG. 1 is the separate components of one upright support frame before assembly.
Figure 1B:
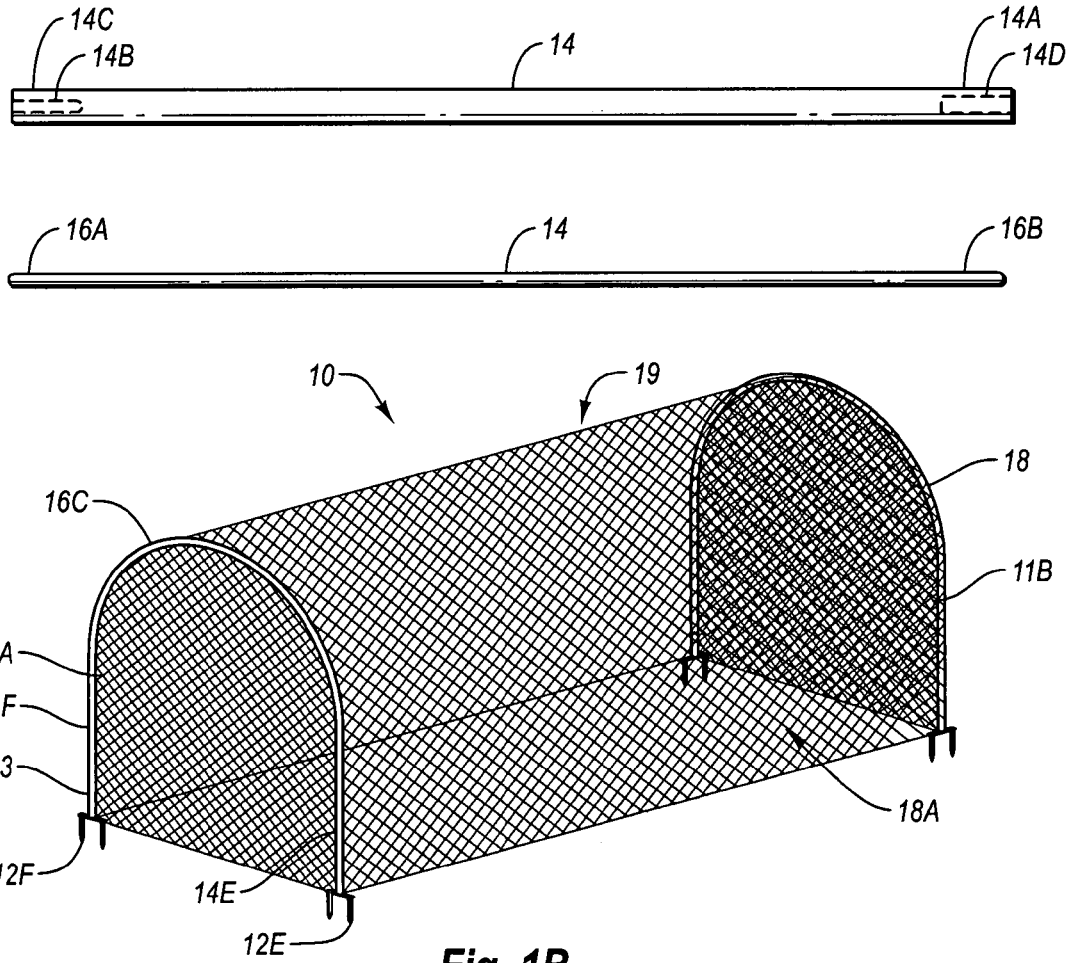
FIG. 1B depicts an assembled practice cage of the present invention.

FIG. 1 depicts parts for a u-shaped frame 11A or 11B for a practice cage 10 seen in FIG. 1B. An anchor base 12 having a pair of stakes 12A and 12B for insertion into the ground or similar soft supporting surface. The stakes 12A and 12B are attached to a base plate 12C by any suitable means including welding and bolts. An upright support 12D is also attached to the base plate 12C by any suitable means including bolting, welding and the like. In some applications, the number of stakes 12A may vary from 1 to as many as many as desired with typical arrangements involving 2. The entire anchor base 12 with the stakes 12A and 12B with the upright support 12D may be unitarily formed and may be formed from metal as well as rigid plastic or any other suitable material that has structural rigidity.

FIG. 1 also depicts one side upright 14 that is hollow at top end 14A and a bottom end 14B. The bottom end 14B has an interior 14C sized to snuggly and yet slideably receive the upright support 12D therein. The upright 14 is sized and formed from a suitably rigid material such as a polystyrene plastic, aluminum, steel, or the like to be relatively rigid. A top support 16 is formed from a suitably flexible material such as nylon, teflon, small (e.g., about 1 inch) diameter plastics, or other hollow and thin walled materials such as aluminum. The top support 16 has ends 16A and 16B each sized to snuggly fit into the interior 14D end 14A of the upright 14 and a projectile barrier 18.

FIG. 1B. shows "u" shaped frame 11A assembled by placing two anchor bases 12E and 12F in a suitable support like the ground 13. Two uprights 14E and 14F are provided with the lower end 14B of each positioned telescopingly over the upright support 12D of their respective anchor bases 12E and 12F. A top support 16C is then assembled to the upper ends 14A of each of the uprights 14E and 14F to from the u shaped frame 11A. A similar assembly is effected to from u shaped frame 11B. A netting material 19 is also as part of the cage 18 shown that allows light in, but that is sized with a plurality of openings sized so that the object/ball used in the practice cannot pass through or out. Notably the netting is flexible or pliable so that it can be pushed out of the way to allow the user to lift the netting 19 and crawl into the space 18A defined by the netting 19.

Figure 1A:
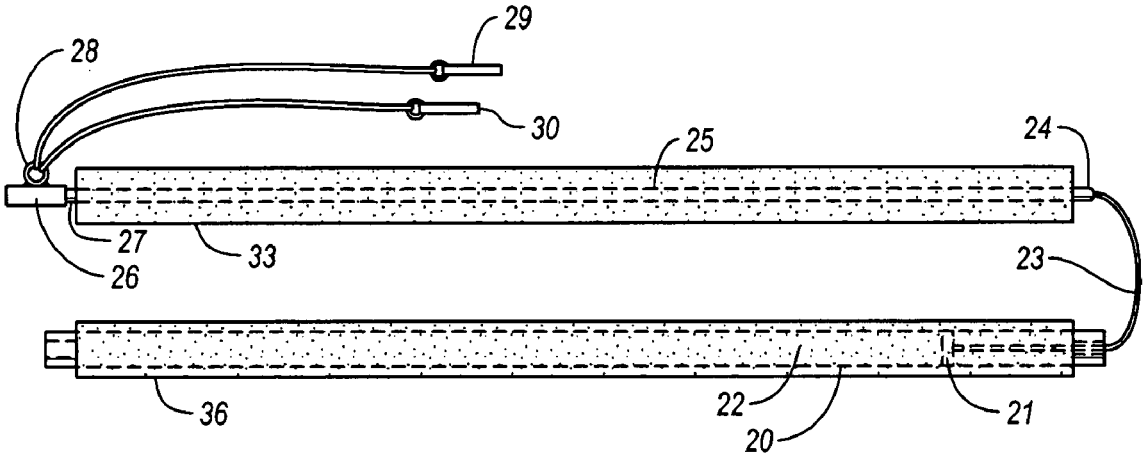
FIG. 1A depicts an alternate arrangement for components of a frame.

FIG. 1A shows an upright 20 comparable to upright 14 which is a hollow tube. An expanding spring or ring 21 is placed in the hollow interior 22 and frictionally engages the wall of the upright 20. An elastic member 23 is attached to the ring 23 and extends to and is attached to one end 24 of suitable half top support 25 which extends about the half the width of the practice cage to be assembled. A hollow engaging bracket 26 is snuggly slid over the other end 27 of the half top support 25. The bracket 26 receives another half top support to form a full top support. Attached to the bracket 26 is a rope ring 28 through which an anchor rope 31 is threaded to extend the entire length of the batting case with ground engaging stakes 29 and 30. The half top support 25 and the upright 22 are here shown encased by a suitable resilient or flexible covers 32 and 33. They may be made of any suitable material to absorb energy supplied by a moving ball or similar object. The flexible covers 32 and 33 are preferably made of a suitable open cell foam.

Figure 2A:
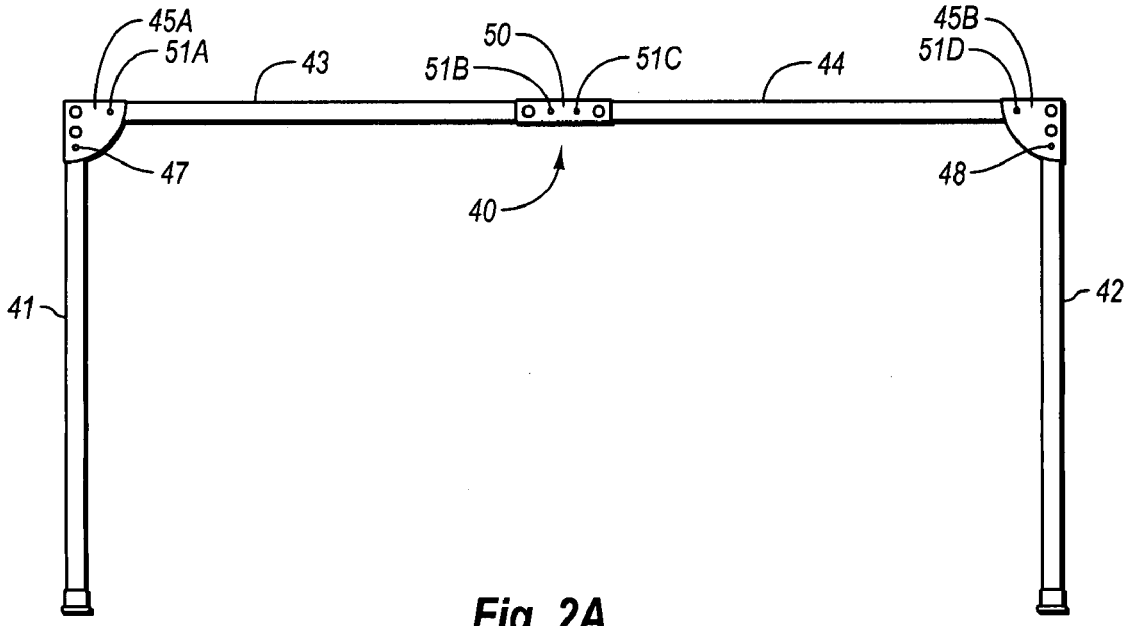
FIGS. 2A-2C illustrate a base support for use with a single ended cage.
Figure 2B:
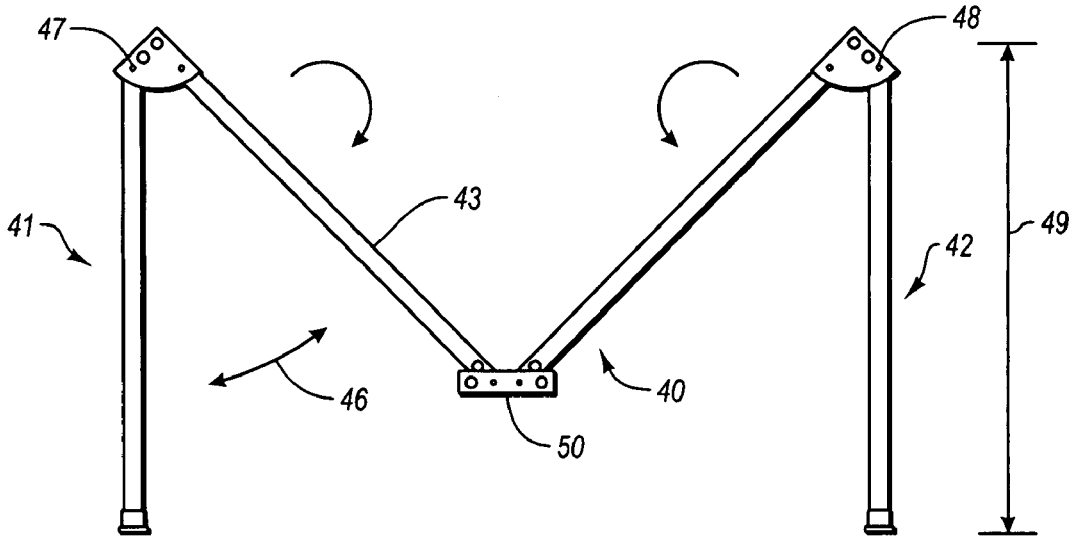
Figure 2C:
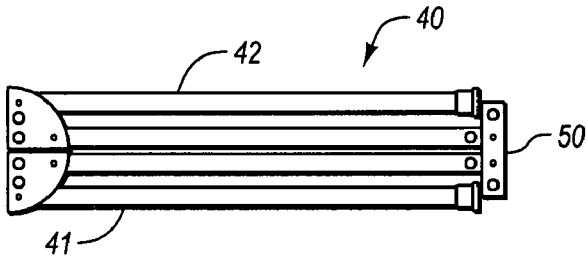

In FIGS. 2A-2C illustrate a base support 40 having a left leg 41, a right leg 42 an left cross member 43 and a right cross member 44. The left leg 41 is hingedly secured to a left leg bracket 45 and may be rotated inwardly and outwardly 46 toward the left cross member 43. When fully extended outwardly, the left leg 41 locks into place with a ball and detent 47. Of course one may use friction ledges, pins, notches or any other suitable arrangement to moveably hold the leg 41 in place when extended as seen in FIG. 2A. The right leg 42 is similarly hinged to rotate between or from a stored position seen in FIG. 2C to the extended position seen in FIG. 2A. The right leg is held in the extended position by a ball detent structure 48 comparable to ball detent 47. The right leg 42 and the left leg 41 are sized in length 49 so that in the stored position, the right leg 42 and left leg 41 both fit snuggly in position between the left bracket 45A and right bracket 45B and the middle bracket 50.

In FIGS. 2A-2C, the left cross member 43 and right cross member 44 are hingedly mounted to the brackets 45A and 45B as well as the middle bracket 50. When extended, suitable ball detent structures 51A-D lock or hold the cross members 43 and 44. Yet a user may easily fold them into the configuration seen in FIG. 2C for storage.

Figure 3:
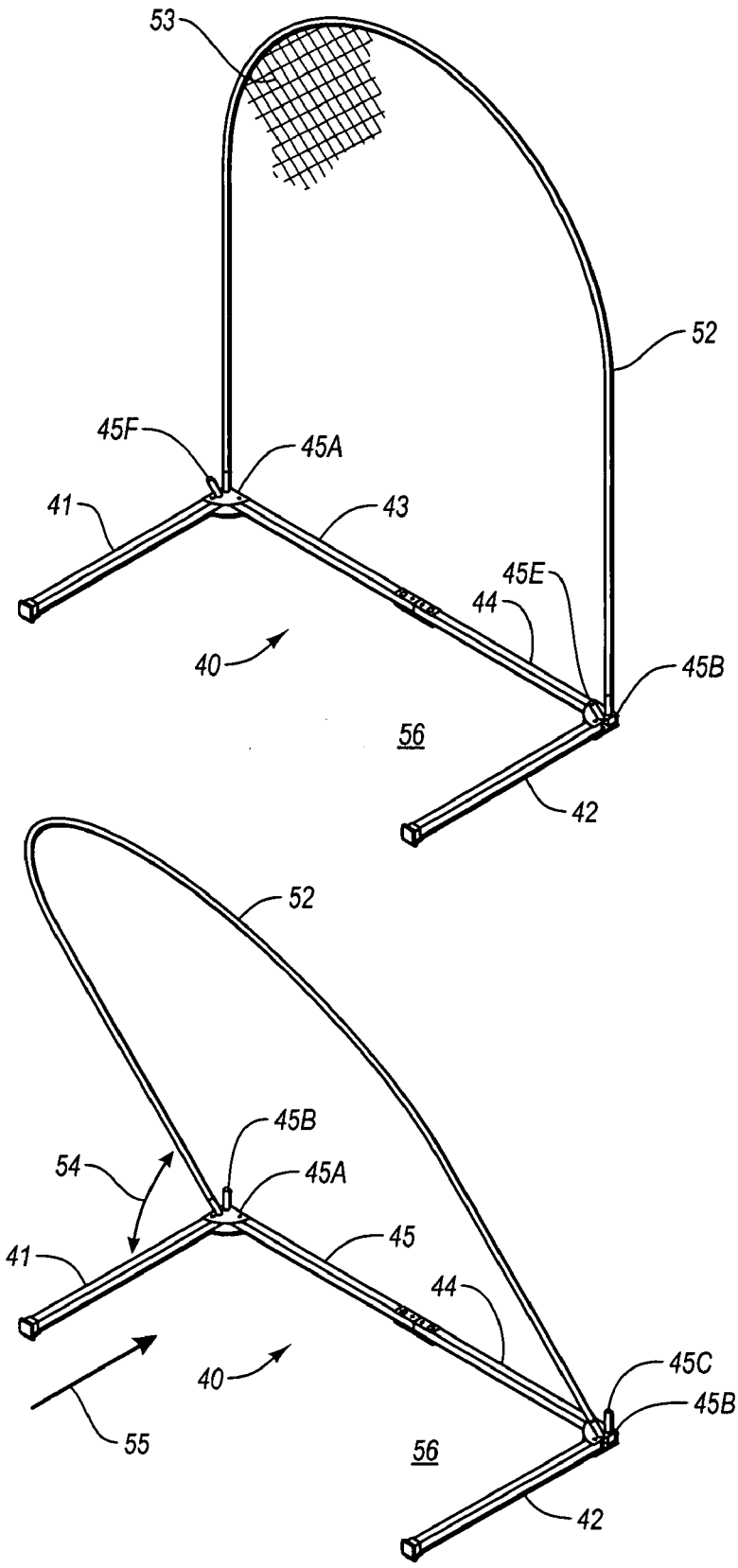
FIGS. 3A and 3B are perspective views a frame for a single ended practice cage using a base support of FIGS. 2A-2C; fully assembled inverted u-shaped practice cage of the present invention.

In FIGS. 3A and 3B, the base 40 is assembled and positioned in its extended position seen in FIG. 2A and then placed on the ground. The brackets 45A and 45B each have two supports 45C, 45D, 45E and 45F. Supports 45C and 45D extend upwardly essentially vertical and are formed to connect with a flexible frame 52 in an upright position so that netting 53 suspended between the cross members 43 and 44 and the frame 52 is essentially vertical. Thus the netting may be a back stop for thrown balls or configured with an opening as hereafter discussed for a pitching machine. The supports 45E and 45F are at an angle from the vertical and may be selected so that the frame 52 is at an angle of from about 60 degrees to about 80 degrees from the legs 41 and 43 and preferably about 70 degrees. Thus balls or other objects launched at the netting in the direction 55 will impact the netting and drop toward the ground 56 between legs 41 and 42 to be generally retained by the legs 41 and 42.

Figure 4A:
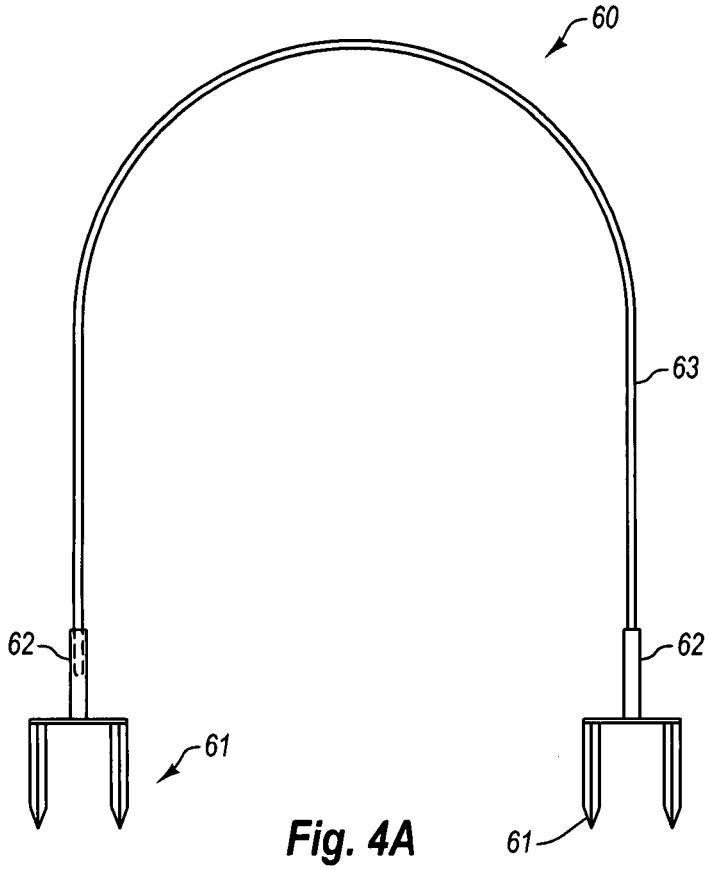
FIGS. 4A and 4B illustrate alternate configurations of a frame for use in the cage of the present invention.
Figure 4B:
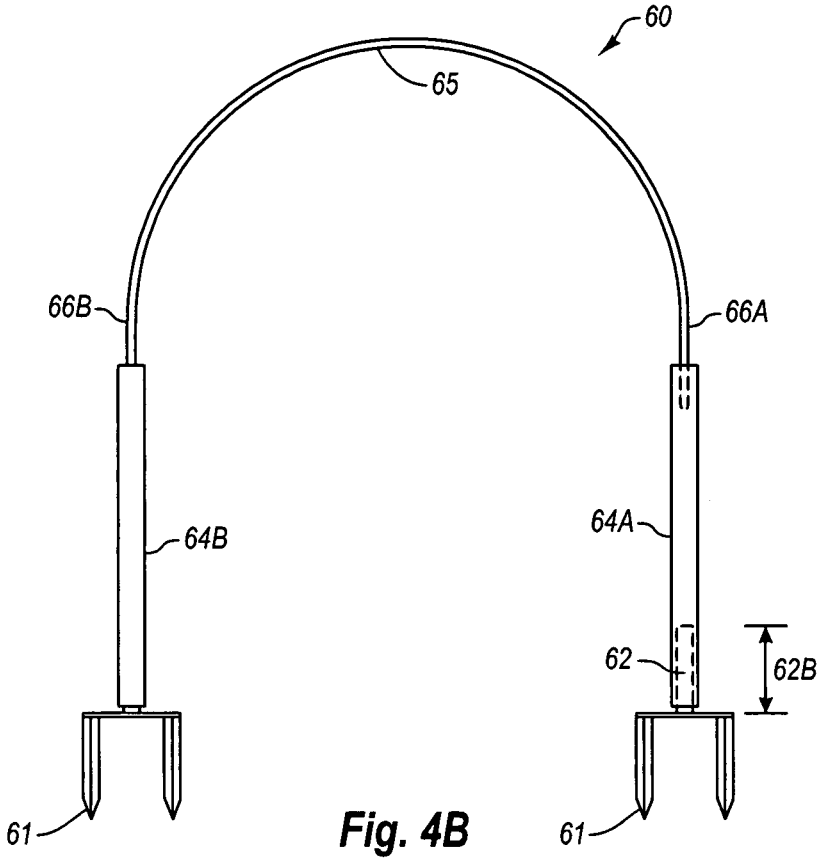

FIG. 4A shows one frame assembly 60 with an anchor base 61 much like anchor base 12 of FIG. 1. In FIG. 4A, the upright support 62 that is hollow and sized to receive a flexible upright frame member 63. In this arrangement, it can be seen that when the frame assembly 60 is located out-of-doors, rain water can get into the hollow upright support 61. Water in the hollow upright support can lead to corrosion, collection of other materials (leaves or other debris) and otherwise interfere with the ability to easily insert or remove the frame member 63. In FIG. 4B, we see a frame 67 having upright supports 64A and 64B that are hollow and larger than the upright support 62. Thus the upright supports 64A and 64B are easily placed over the support 62 which is long enough or high enough 62B to stably support the upright supports 64A and 64B. The upright supports 64A and 64B are rigid and typically made of aluminum, galvanized metal, strong plastics or the like so that it can remain rigid notwithstanding the bending forces 66A and 66B of the upper support 65 when installed as seen in FIG. 4B.

Figure 5A:
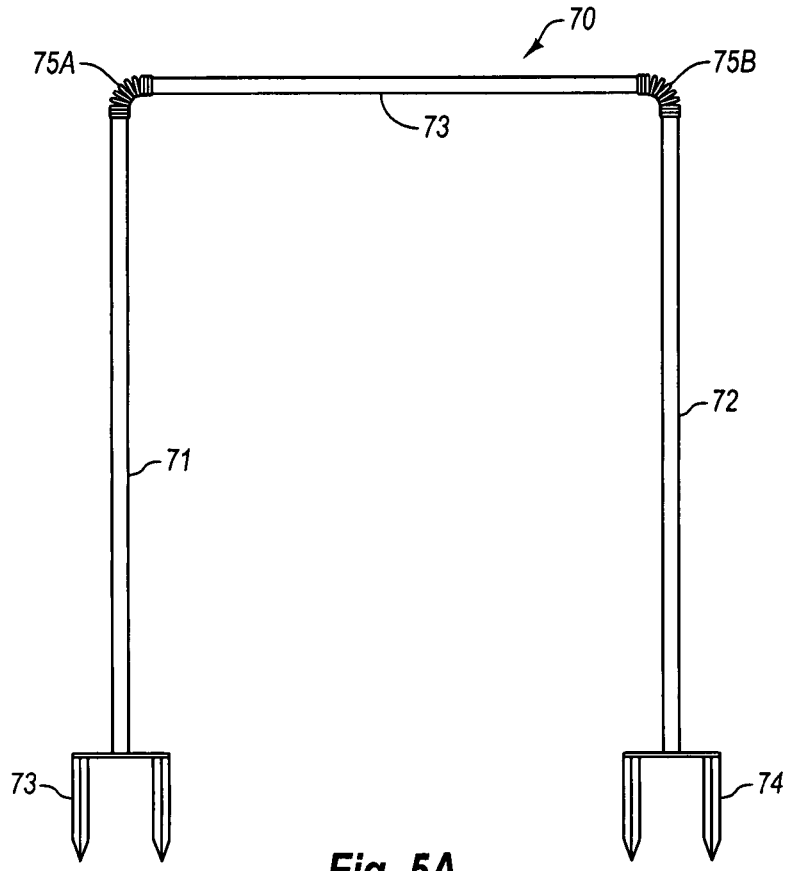
FIGS. 5A and 5B illustrate alternate configurations of a frame for use in the cage of the present invention.
Figure 5B:
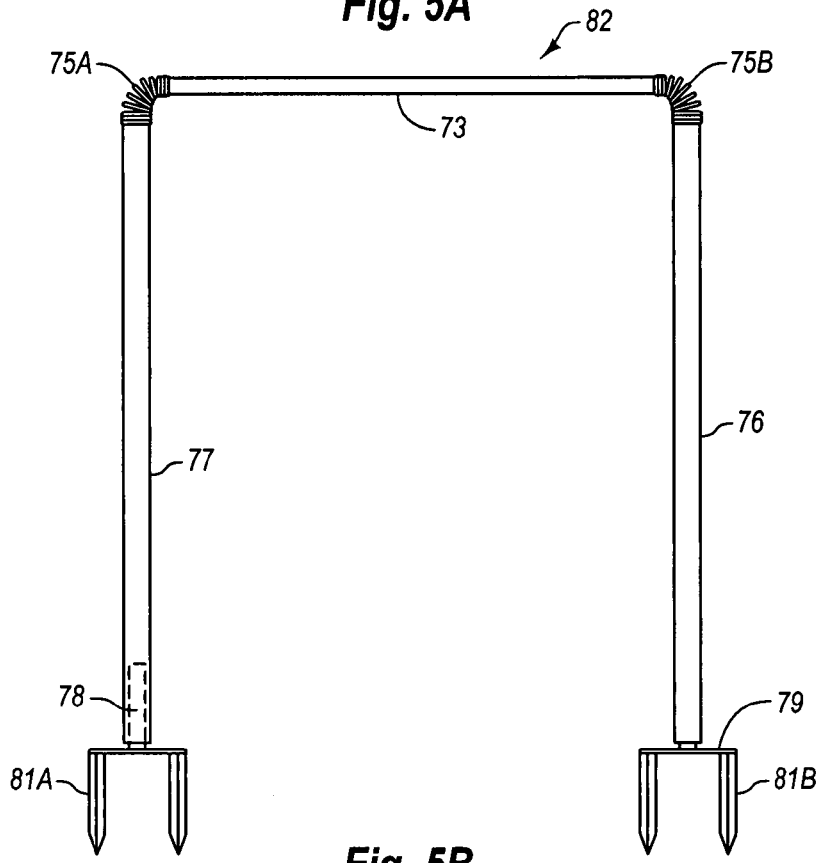

In FIG. 5A, a frame 70 is assembled using to uprights 71 and 72 with a cross member 73. The uprights 71 and 72 are fixedly secured to a base member 73 and 74 such as by bolting or welding. The uprights 71 and 72 are each connected to the cross member 73 by a spring 75A and 75B. The springs 75A and 75B each are both coil springs and sized to snuggly surround and grasp the uprights 71 and 72 which are in fact essentially circular in cross section. In turn, assembly involves grasping the springs with a user's hand and rotating the springs 75A and 75B at their opposite ends one at a time to fit them onto the ends of the cross member 73 and uprights 72 and 73. FIG. 5B shows a frame 82 which is identical to FIG. 5A except that the cross members 76 and 77 are slideably mounted over uprights supports 78 and 79 extending from anchor supports 80 and 81 comparable to support 62 of the anchor 61 in FIG. 4B.

Figure 6A:
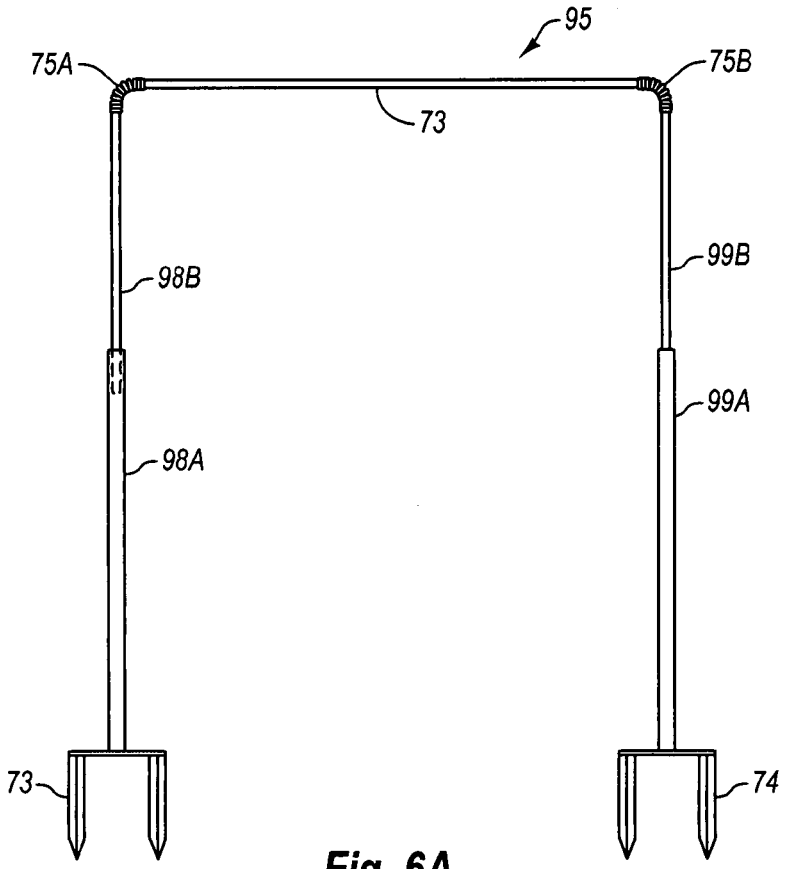
FIGS. 6A and 6 B illustrate alternate configurations of a frame for use in the cage of the present invention.
Figure 6B:
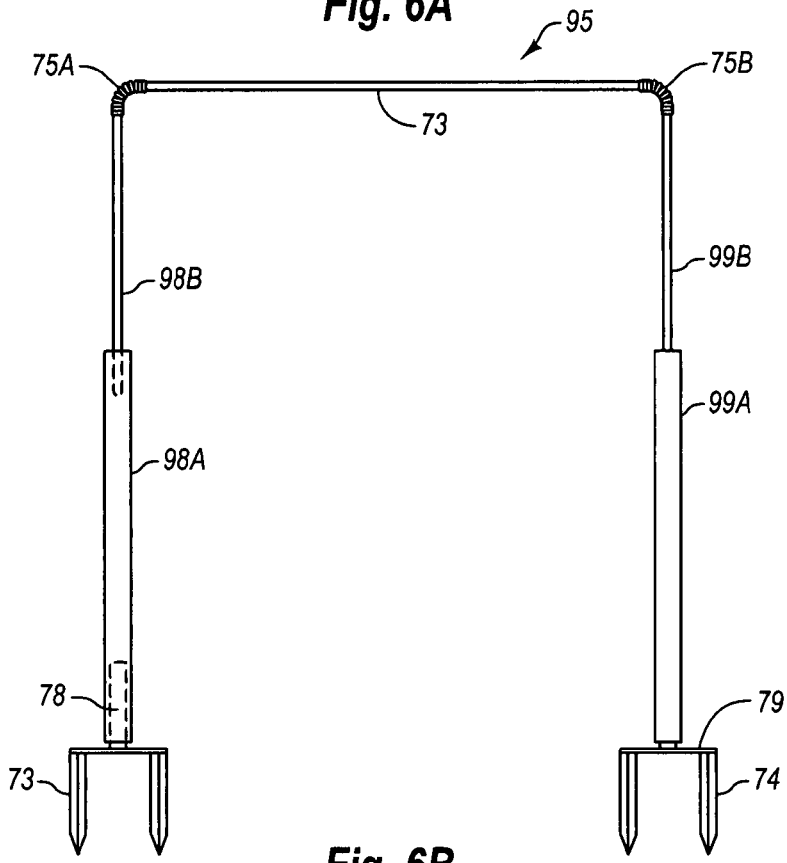

FIGS. 6A and 6B show frames 95 and 96 which are almost the same as frames 70 and 82 of FIGS. 5A and 5B except that the uprights are made of two telescoping pieces 98A and 98B and 99A and 99B is connected to the uprights 71 and 72 by elbows.

Figure 7A:
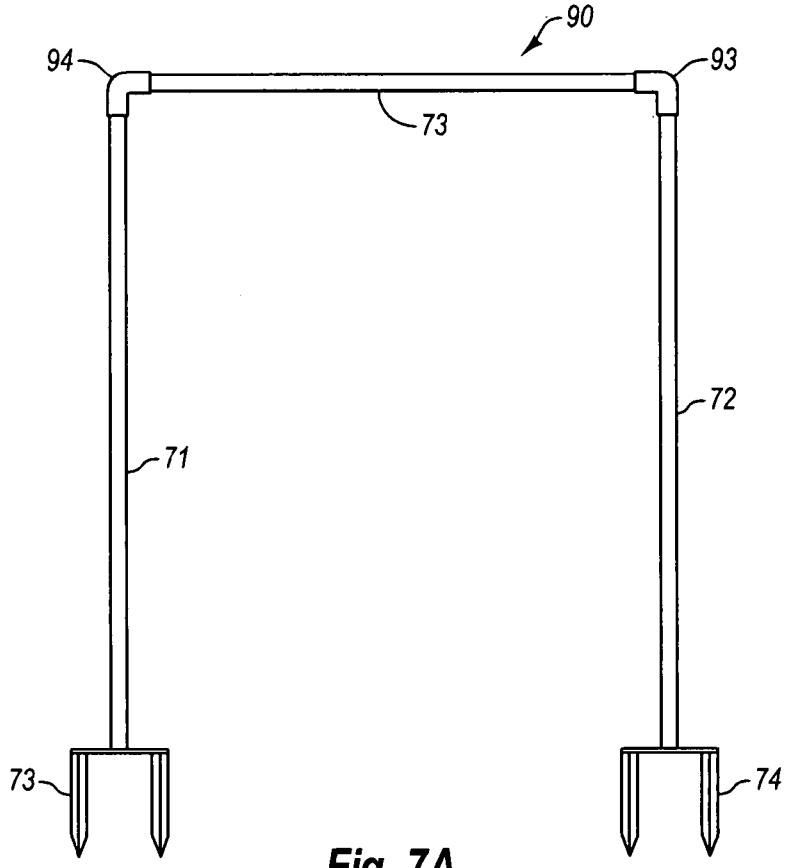
FIGS. 7A and 7B illustrate alternate configurations of a frame for use in the cage of the present invention.
Figure 7B:
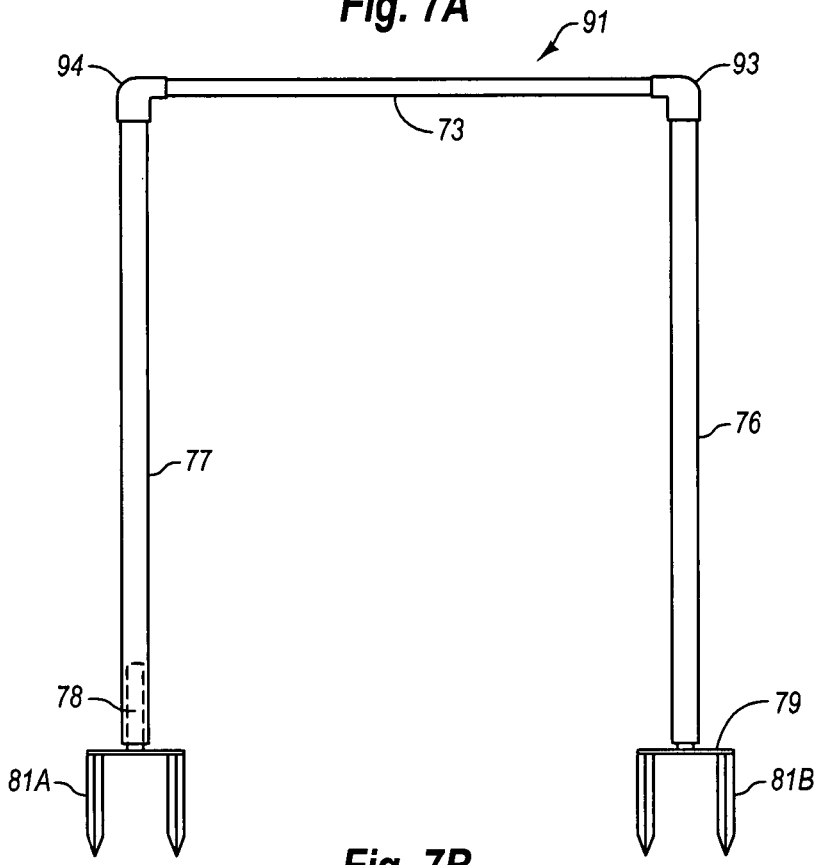

FIGS. 7A and 7B show frames 90 and 91, the same frames 70 and 82 of FIGS. 5A and 5B except that the cross support 73 is connected to the uprights 71 and 72 by elbows 93 and 94.

Figure 8A:
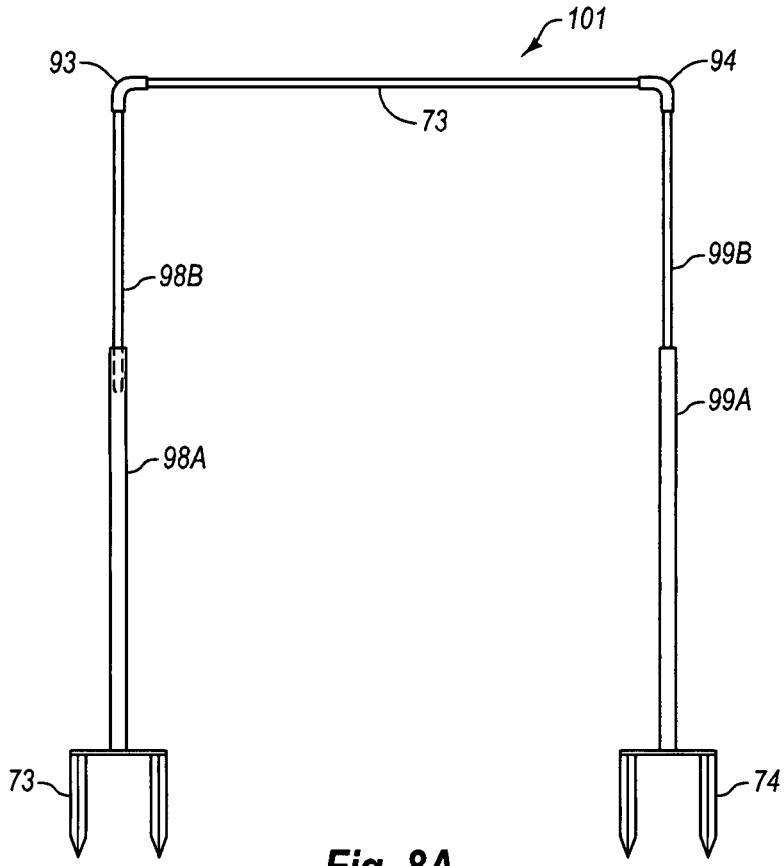
FIGS. 8A and 8B illustrate alternate configurations of a frame for use in a cage of the present invention.
Figure 8B:
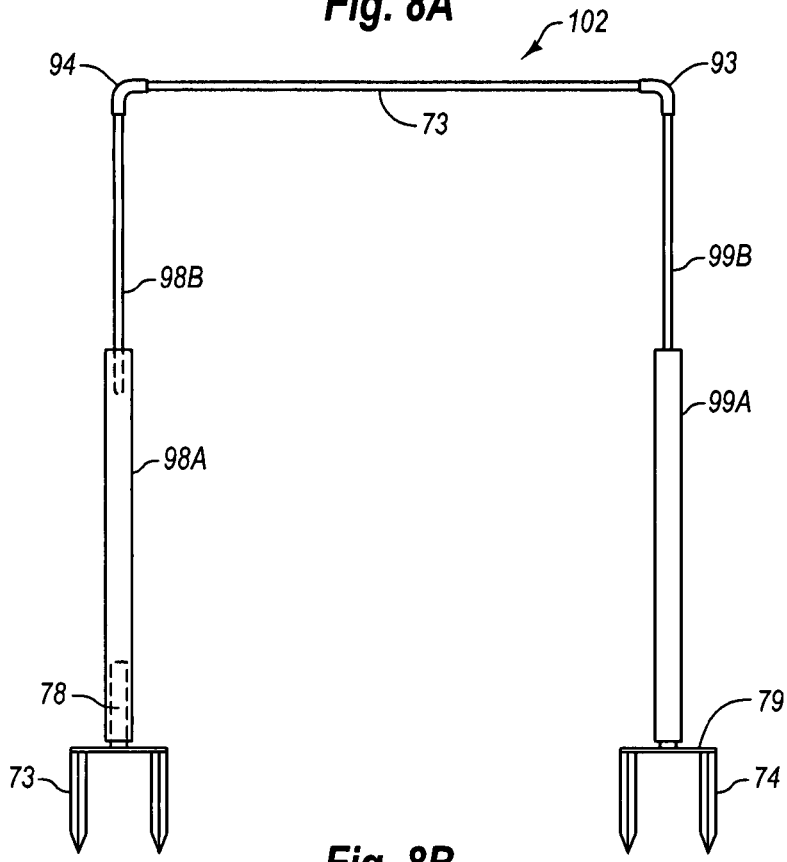

FIGS. 8A and 8B show frames 101 and 102 comparable to frames 95 and 96 of FIGS. 6A and 6B except that elbows 94 and 95 are used in lieu of springs 75A and 75B.

Figure 9A:
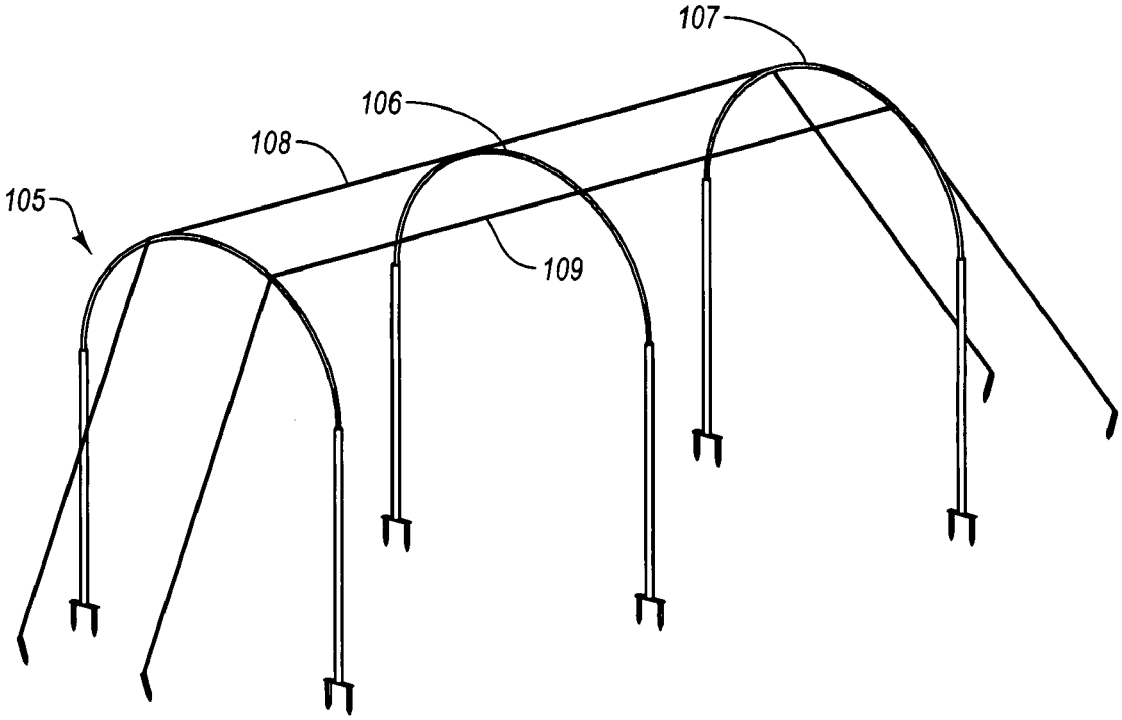
FIGS. 9A and 9B show frames arranged for use with cages of the present invention.
Figure 9B:
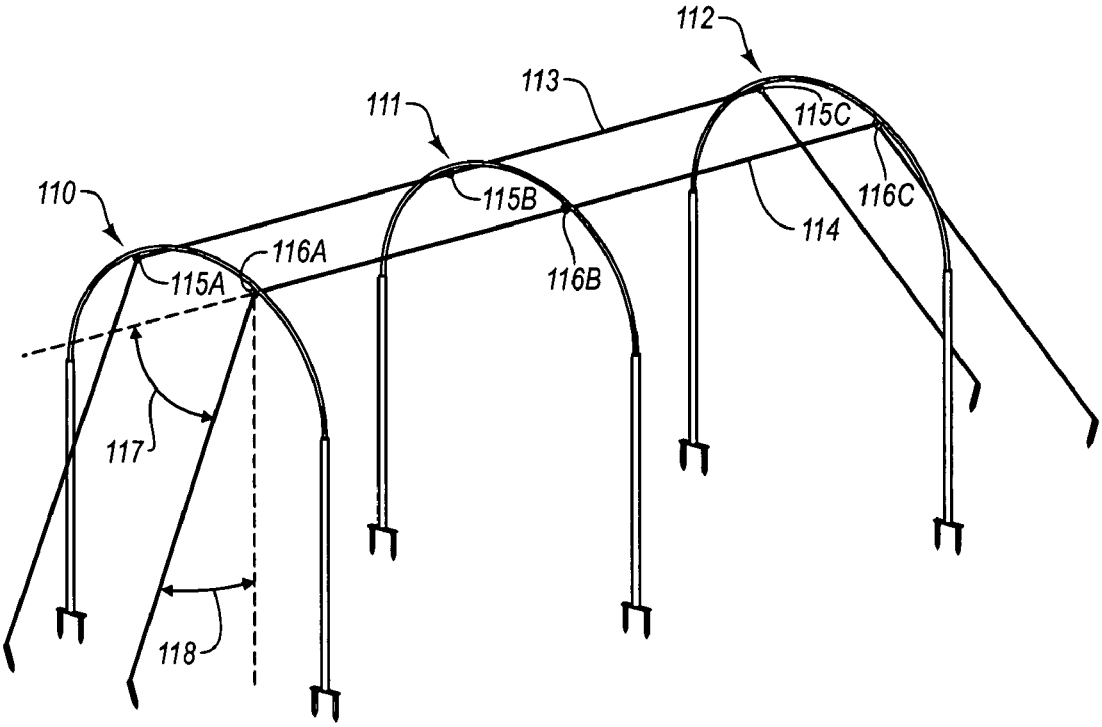

FIG. 9A shows a plurality of three frames 105, 106 and 107 with ropes 108 and 109 extending over them to hold them stably in place. FIG. 9B shows frames 110, 111 and 112 being held in place by ropes 113 and 114 that are threaded through suitable rings or eyes 115A-C and 116A-C to stably support a cage assembled with a net over the frames 110-112. The ropes 108 and 109 angle 117 downward and away from the end frames 110 and 112 or are angled 118 from the vertical to provide a tensional support to the cage when assembled. The ropes are useful for cages with frames that are made of materials that have more flex than desired and thus need support.

Figure 10:
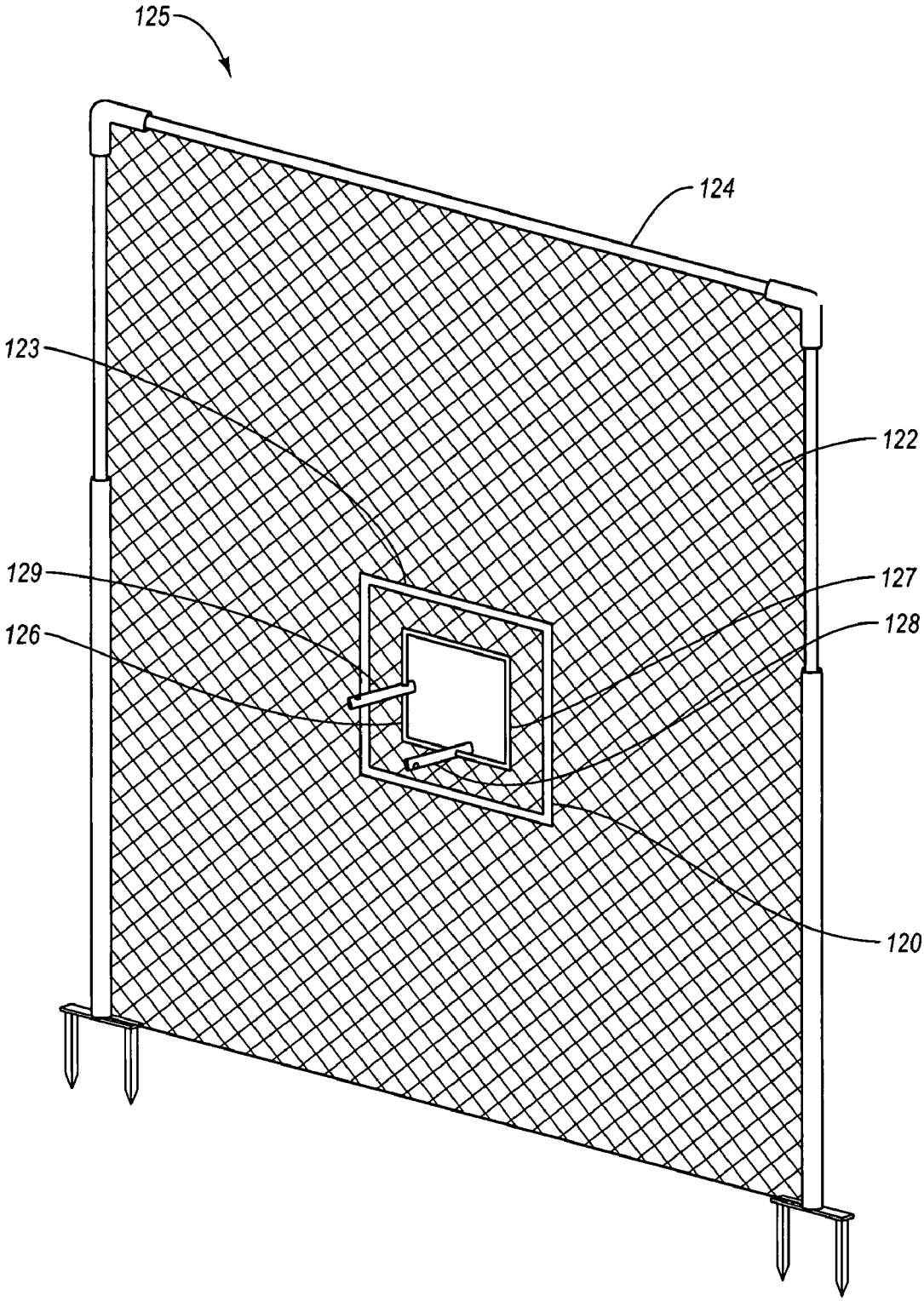
FIG. 10 shows a window structure for use with a cage of the present invention.
Figure 11:
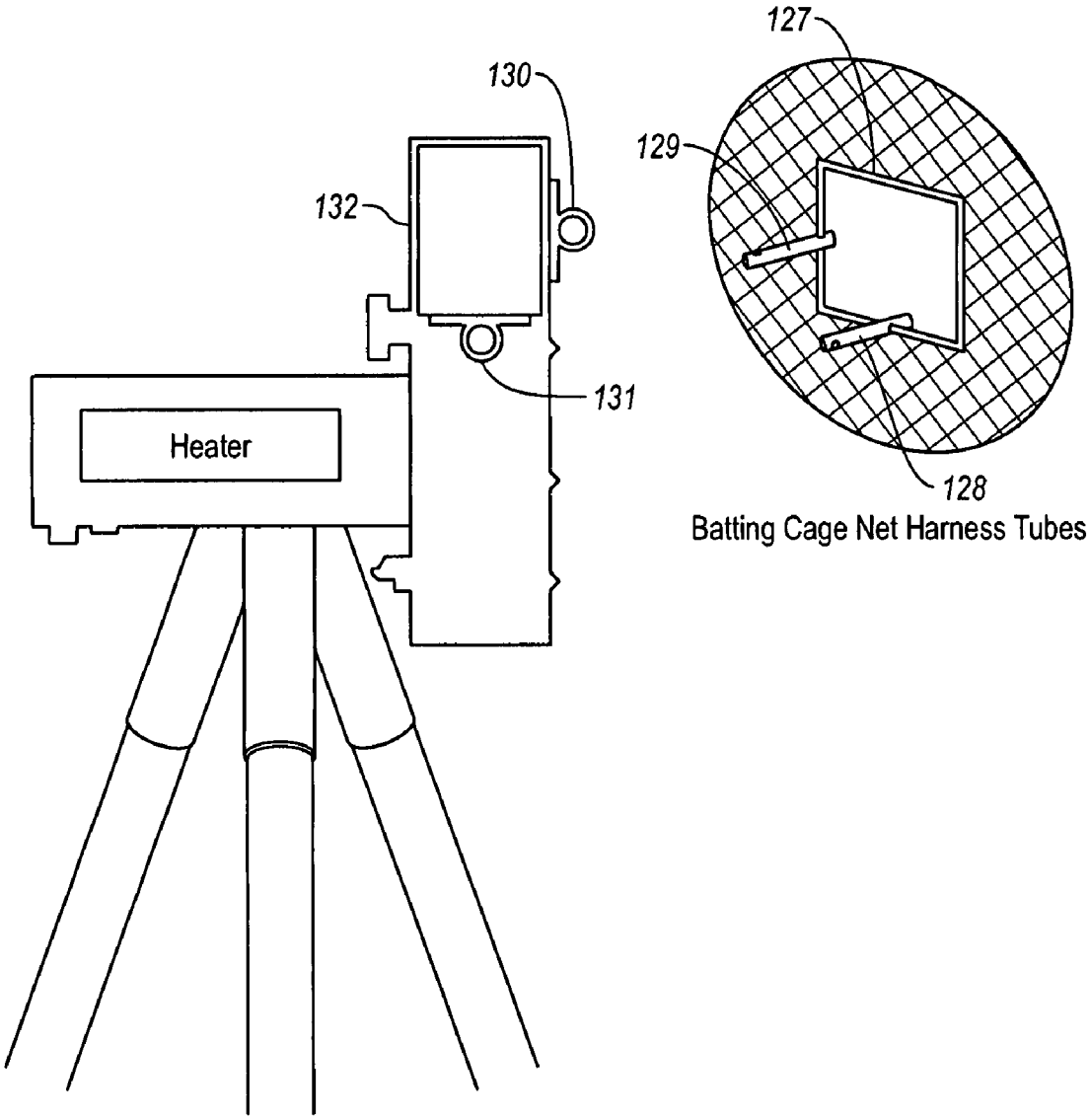
FIG. 11 shows a window insert and pitching machine for use with a cage of the present invention.
Figure 12:
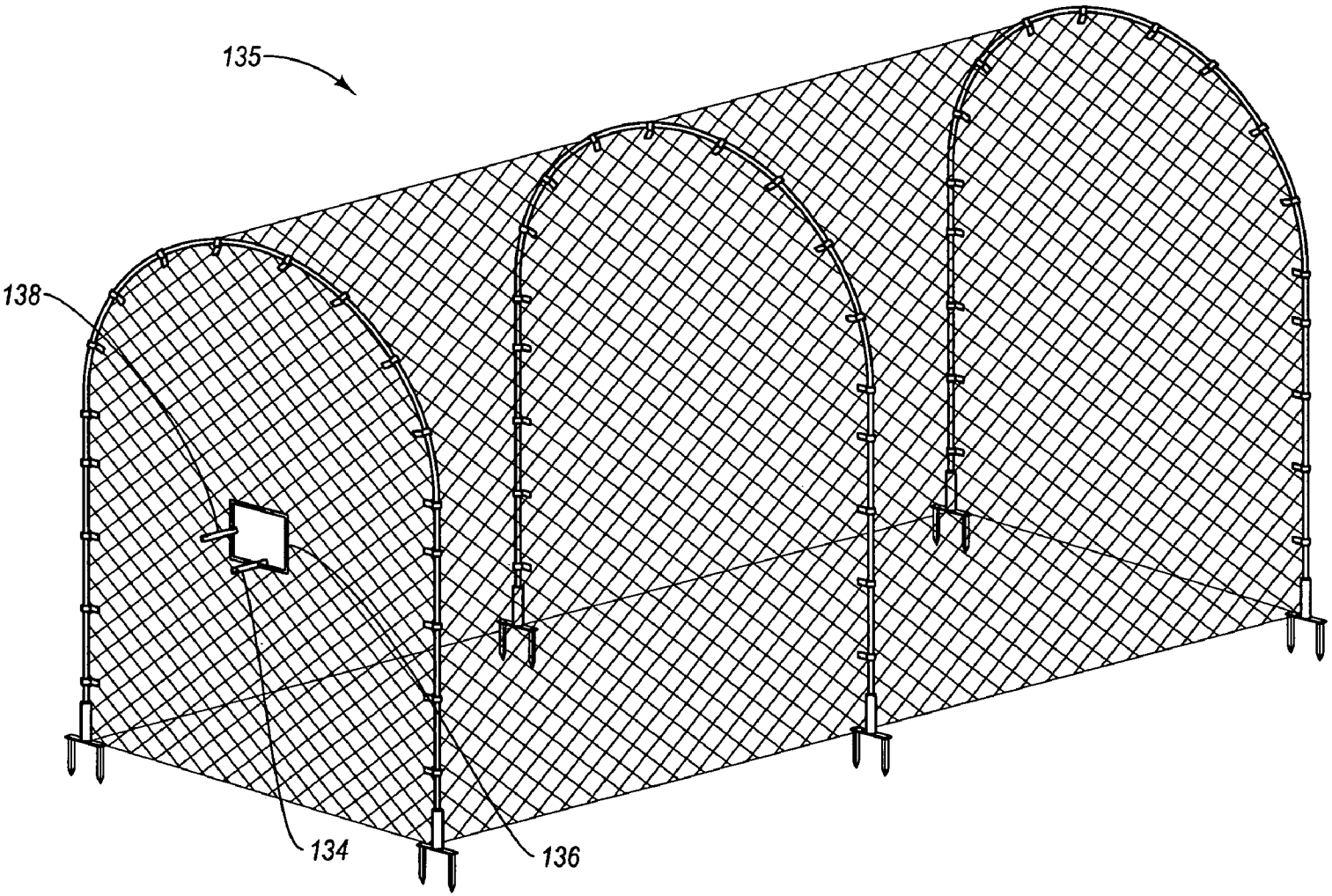
FIGS. 12-18 show alternate forms of cages of the present invention.

In some instances, a ball pitching machine is desirably associated with a cage. To simply make an opening in the webbing or netting of a cage sized to allow balls to be pitched in also allows balls to be propelled outwardly. In FIG. 10, an opening 120 formed in the netting or webbing 122 is suspended from a frame 124 which is part of a cage 125 assembled comparable to that seen in FIG. 6A. The opening 120 is formed with a zipper 123 and may receive therein a piece of webbing or netting that is held in place by a zipper. Alternately, a frame 126 may be zipped into the opening. The frame has a rigid perimeter 127 with alignment extensions 128 and 129 extending therefrom which are sized to snuggly but slideably register and fit with alignment eyes 130 and 131 as seen in FIG. 11. Of course the ball outlet 132 aligns and registers with the perimeter 127. Thus a batting cage 135 seen in FIG. 12 may have a ball pitching frame 136 that is permanently installed and aligns with a pitching machine using alignment extensions 138 and 139 comparable to extensions 128 and 129.

Figure 13:
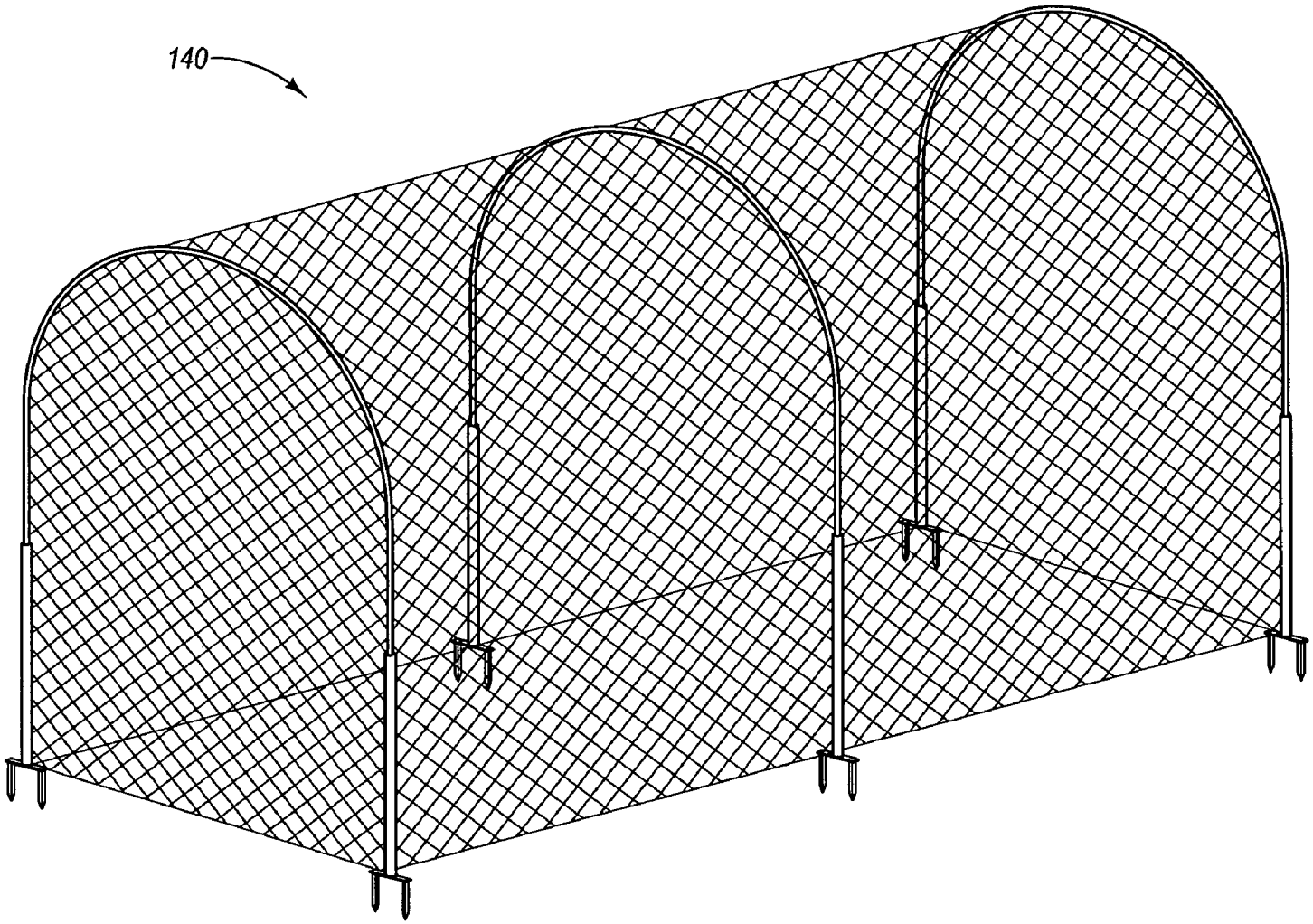

FIG. 13 shows a practice cage 140 formed from three frame members 141A-C comparable to frame members shown in FIG. 4B. A number of additional frame members may be used to strengthen or to extend the cage. 140. A netting 142 is positioned over the frame with openings sized to retain balls therewith.

Figure 14:
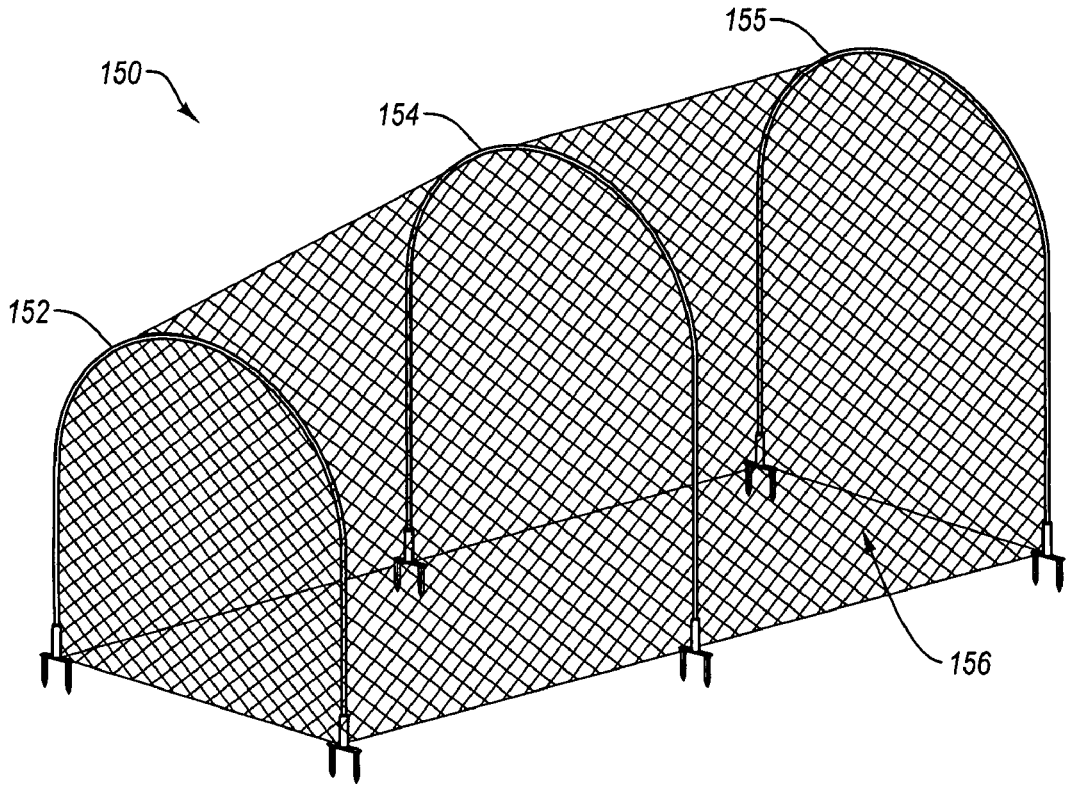
Figure 15:
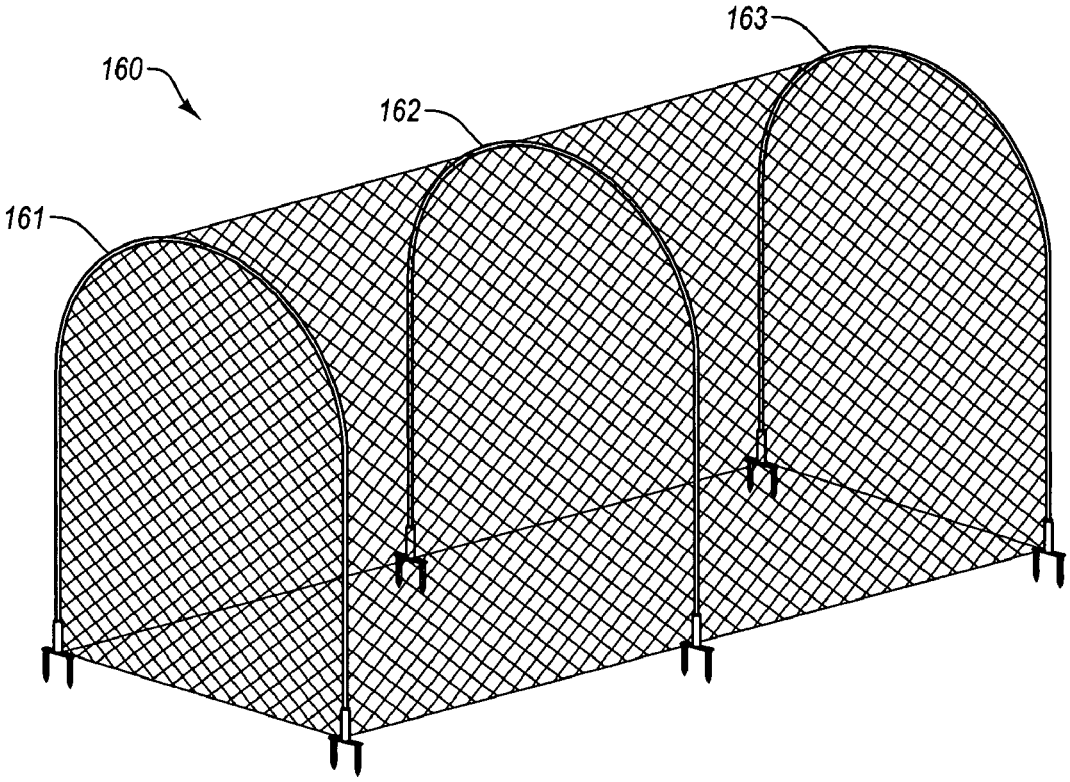
Figure 16:
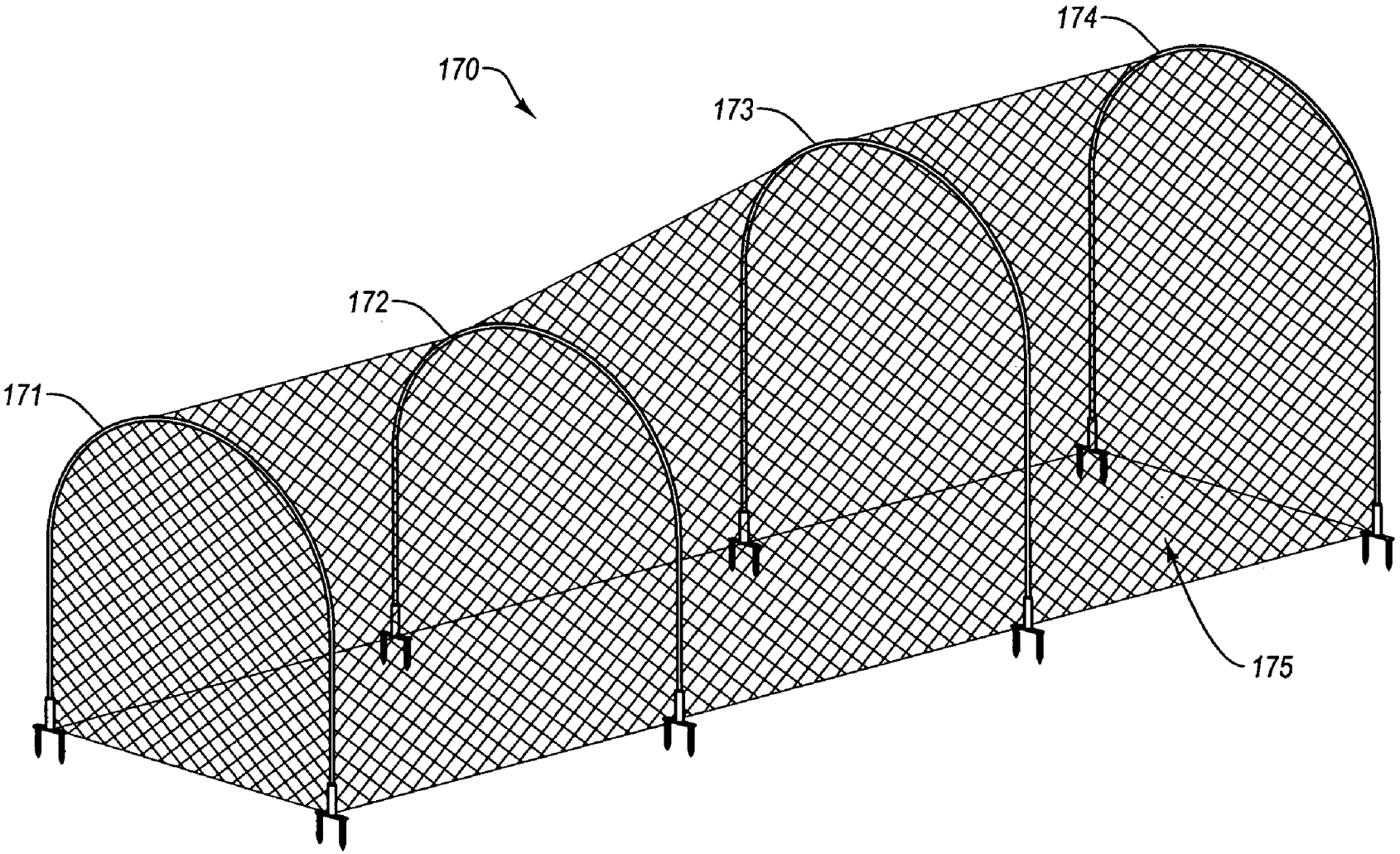
Figure 17:
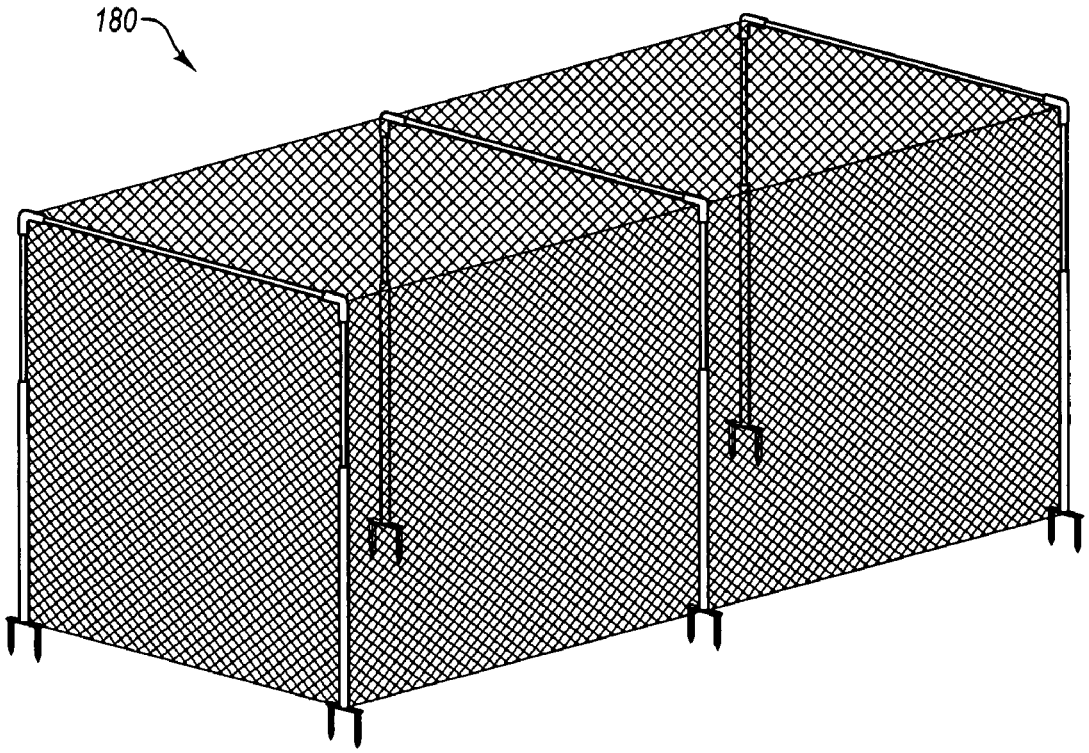
Figure 18:
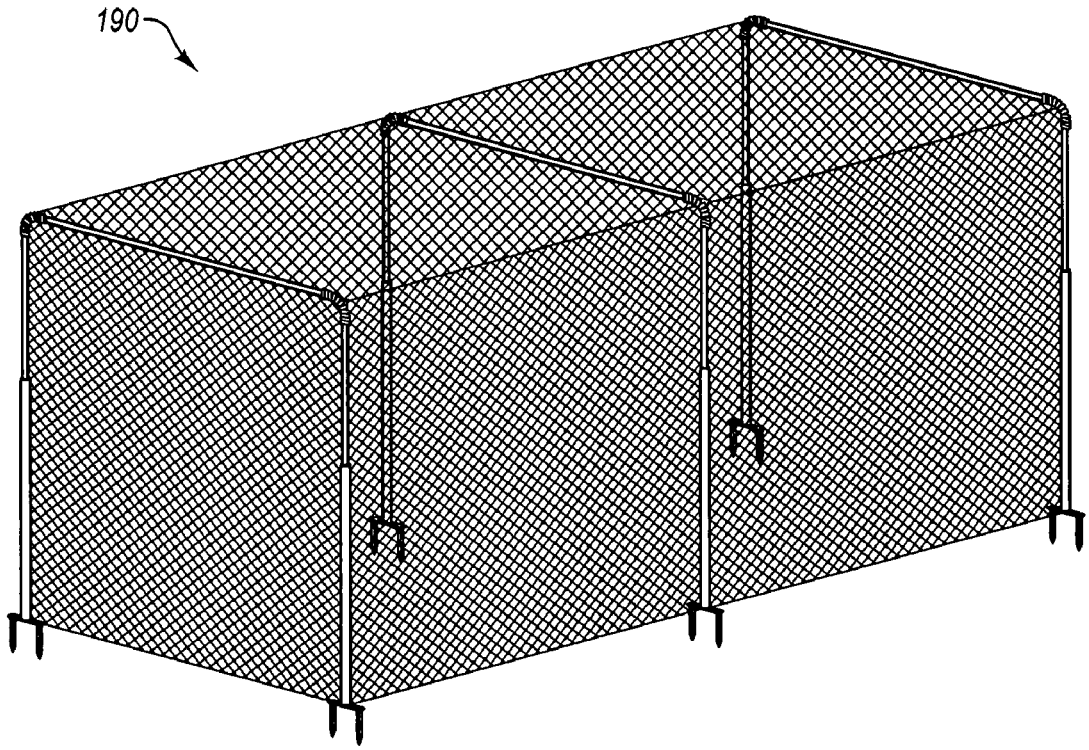

FIG. 14 shows a cage 150 formed from frame member 152 smaller than frame members 154 and 155. The larger frame members 154 and 155 are sized to form an area 156 to accommodate a batter. FIG. 15 shows a cage 160 using frames 161, 162 and 163 that are made of one piece of flexible material. FIG. 16 shows a cage 170 formed from two small frame members 171 and 172 and two large frame members 173 and 174 to create an area 175 for the user like a batter or kicker. FIG. 17 shows a cage 180 formed of frame members comparable to those shown in FIGS. 8A and 8B. FIG. 18 shows a cage 180 formed of frame members comparable to those shown in FIGS. 6A and 6B. Accordingly, it can be seen that although the description above contains many specificities, these should not be construed as limiting the scope of the invention but as merely providing illustrations of some of the presently preferred embodiments of this invention.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A combination resiliently rigid and flexible structure disposed on a surface for use with a moveable object comprising:

a) at least one rigid frame member made of a first material and at least one flexible frame member made of a second material different from the first material;

i) the at least one rigid frame member comprising an at least one rigid upright member for association with and extending upwardly from the surface to provide substantially vertical upright rigidity for maintaining a swinging area, the at least one rigid upright member having a lower end for associating with the surface and an upper end for connection to at least one flexible frame member such that the at least one rigid upright member maintains rigidity against bending forces applied by the connection to at least one flexible frame member;

ii) the at least one flexible frame member comprising an at least one arched, flexible cross member, the at least one arched, flexible cross member having at least one distal end and at least one proximal end, the at least one proximal end for assembly with the upper end of at least one rigid upright member to inhibit overflexing of the flexible cross member while providing flexibility against wind forces that may act on the combination resiliently rigid and flexible structure;

b) barrier means associated with the at least one rigid frame member and the at least one flexible frame member, the barrier means being configured to restrain the moveable object, the barrier means having an opening for allowing the moveable object to pass from an external object projecting device through the barrier means into an internal area defined by the barrier means; and c) a cover harness for attaching the external object projecting device to the barrier means such that the external object projecting device is disposed outside the internal area, the cover harness closing the opening about an entry opening and comprising at least one alignment extension for registering with at least one alignment eye disposed on the external object projecting device for slideably connecting the external object projecting device to the cover harness and aligning the external object projecting device with the entry opening in the cover harness.

2. A combination resiliently rigid and flexible structure as recited in claim 1, wherein the at least one distal end of at least one arched, flexible cross member is associated with the surface.

3. A combination resiliently rigid and flexible structure as recited in claim 1, wherein the at least one rigid upright comprises metal tubing of a predetermined size.

4. A combination resiliently rigid and flexible structure as recited in claim 1, wherein the at least one arched, flexible cross member comprises a fiberglass rod of a predetermined size.

5. A combination resiliently rigid and flexible structure as recited in claim 1, wherein at least a portion of the barrier means comprises netting.

6. A combination resiliently rigid and flexible structure as recited in claim 1, further comprising a connection means associated with the opening for associating the cover harness with the barrier means and the external object projecting device.

7. A combination resiliently rigid and flexible structure as recited in claim 1, further comprising at least one anchor base for associating the lower end of the at least one rigid upright member with the surface.

8. A combination resiliently rigid and flexible structure as recited in claim 1, further comprising at least one anchor base for associating the distal end of the at least one arched, flexible cross member with the surface.

9. A combination resiliently rigid and flexible structure as recited in claim 1, wherein the at least one rigid upright member comprises at least one first side rigid upright member and at least one second side rigid upright member, the lower end of at least one first side rigid upright member associates with the surface, the upper end of at least one first side rigid upright member assembles with the proximal end of at least one arched, flexible cross member, the distal end of at least one arched, flexible cross member assembles with the upper end of at least one second side rigid upright member, the lower end of at least one second side rigid upright member associates with the surface.

10. A combination resiliently rigid and flexible structure as recited in claim 9, wherein at least one first side rigid upright member and at least one second side rigid upright member retain at least one flexible cross member in an arched disposition.

11. A combination resiliently rigid and flexible structure as recited in claim 1, further comprising:

a) at least one anchor rope for stabilizing at least one of either at least one rigid frame member or at least one arched, flexible frame member;

b) at least one surface engaging stake associated with the at least one anchor rope; and c) at least one resilient pad for cushioning at least one of either at least one rigid frame member or at least one flexible frame member from contact by the moveable object.

12. A resiliently flexible structure disposed on a surface for use with a moveable object comprising:

a) at least one flexible frame member comprising a flexible cross member having a proximal end and a distal end, the proximal end for disposition on the surface, the distal end for disposition on the surface;

b) a cover attached to the at least one flexible cross member for defining an internal area and restraining the moveable object within the internal area, the cover having an opening for allowing the moveable object to pass through the cover; and c) a cover harness disposed within the opening to inhibit exit of the moveable object from the internal area and for attaching an external object to the cover such that the external object is disposed outside the internal area defined by the cover, the cover harness comprising a barrier material and an entry opening, the entry opening being smaller than the opening in the cover, the cover harness having at least one alignment extension for registering with at least one alignment eye disposed on the external object for slideably connecting the external object to the cover harness and aligning the external object with the entry opening in the cover harness.

13. A resiliently flexible structure as recited in claim 12, further comprising at least one anchor base for associating at least one flexible cross member with the surface.

14. A resiliently flexible structure as recited in claim 12, further comprising:

a) at least one anchor rope associated with the at least one flexible frame member for stabilizing the at least one flexible frame member; and b) at least one surface engaging stake associated with the at least one anchor rope.

15. A practice cage disposed on a surface for use with a moveable object comprising:

a) at least two independent frame members disposed on the surface;

b) a cover attached to the at least two independent frame members for defining an internal area and restraining the moveable object, the cover having an opening that allows the moveable object to pass through the cover within the internal area; and c) a cover harness for connection to the opening in the cover and for attaching an external object to the cover such that the external object is disposed outside the internal area defined by the cover, the cover harness having an entry opening and the external object having an outlet, the cover harness comprising at least one alignment extension for registering with at least one alignment eye disposed on the external object for slideably connecting the external object to the cover harness and aligning the outlet of the external object with the entry opening in the cover harness.

16. A practice cage as recited in claim 15, wherein the external object is a pitching machine and the outlet is a ball outlet.

17. A practice cage as recited in claim 15, further comprising:

a) at least one anchor rope associated with at least one of the at least two independent frame members for stabilizing at least one of the at least two independent frame members; and b) at least one surface engaging stake associated with the at least one anchor rope.

18. A practice cage as recited in claim 15, further comprising at least one resilient pad for cushioning at least one of the at least two independent frame members from contact by the moveable object.

19. A resiliently flexible structure as recited in claim 12 wherein the opening has a first zipper portion and the cover harness has a second zipper portion and attaching the cover harness to the cover comprises joining the first zipper portion to second zipper portion in zipper engagement.

20. A resiliently flexible structure as recited in claim 19, further comprising a closure piece having a third zipper portion and wherein the closure piece is attachable to the cover to close the cover opening when the cover harness is detached from the cover, attaching the closure piece to the cover comprises joining the first zipper portion to third zipper portion in zipper engagement.

* * * * *